US008345899B2

(12) United States Patent
Merimaa et al.

(10) Patent No.: US 8,345,899 B2
(45) **Date of Patent: *Jan. 1, 2013**

(54) PHASE-AMPLITUDE MATRIXED SURROUND DECODER

(75) Inventors: Juha Merimaa, Santa Cruz, CA (US); Jean-Marc Jot, Aptos, CA (US); Michael M. Goodwin, Scotts Valley, CA (US); Arvindh Krishnaswamy, San Jose, CA (US); Jean Laroche, Santa Cruz, CA (US)

(73) Assignee: Creative Technology Ltd, Singapore (SG)

( * ) Notice: Subject to any disclaimer, the term of this patent is extended or adjusted under 35 U.S.C. 154(b) by 1181 days.

This patent is subject to a terminal disclaimer.

(21) Appl. No.: 12/047,285

(22) Filed: Mar. 12, 2008

(65) Prior Publication Data

US 2008/0205676 A1 Aug. 28, 2008

Related U.S. Application Data

(63) Continuation-in-part of application No. 11/750,300, filed on May 17, 2007.

(60) Provisional application No. 60/894,437, filed on Mar. 12, 2007, provisional application No. 60/977,432, filed on Oct. 4, 2007, provisional application No. 60/747,532, filed on May 17, 2006.

(51) Int. Cl.
*H04R 5/02* (2006.01)

(52) U.S. Cl. ..... 381/310; 381/1; 381/17; 381/18; 381/20; 381/22; 381/23; 704/500; 704/501; 704/200.1; 704/E19.005

(58) Field of Classification Search ..... 381/307–310, 381/1, 17–23; 704/200.1, 230, E19.005, 704/500–501
See application file for complete search history.

(56) References Cited

U.S. PATENT DOCUMENTS 7,853,022 B2 * 12/2010 Thompson et al. ..... 381/17
2008/0205676 A1 * 8/2008 Merimaa et al. ..... 381/310
2008/0267413 A1 * 10/2008 Faller ..... 381/1

* cited by examiner

*Primary Examiner* — Disler Paul
(74) *Attorney, Agent, or Firm* — Creative Technology Ltd

(57) ABSTRACT

A frequency domain method for phase-amplitude matrixed surround decoding of 2-channel stereo recordings and soundtracks, based on spatial analysis of 2-D or 3-D directional cues in the recording and re-synthesis of these cues for reproduction on any headphone or loudspeaker playback system.

10 Claims, 8 Drawing Sheets

Fig._3 (prio art)

PHASE-AMPLITUDE MATRIXED SURROUND DECODER

CROSS-REFERENCE TO RELATED APPLICATIONS

This application is a continuation-in-part of U.S. patent application Ser. No. 11/750,300, which is entitled Spatial Audio Coding Based on Universal Spatial Cues, and filed on May 17, 2007 which claims priority to and the benefit of the disclosure of U.S. Provisional Patent Application Ser. No. 60/747,532, filed on May 17, 2006, and entitled "Spatial Audio Coding Based on Universal Spatial Cues" (CLIP159PRV), the specifications of which are incorporated herein by reference in their entirety. Further, this application claims priority to and the benefit of the disclosure of U.S. Provisional Patent Application Ser. No. 60/894,437, filed on Mar. 12, 2007, and entitled "Phase-Amplitude Stereo Decoder and Encoder" (CLIP198PRV). Further, this application claims priority to and the benefit of the disclosure of U.S. Provisional Patent Application Ser. No. 60/977,432, filed on Oct. 4, 2007, and entitled "Phase-Amplitude Stereo Decoder and Encoder" (CLIP228PRV).

BACKGROUND OF THE INVENTION

1. Field of the Invention

The present invention relates to signal processing techniques. More particularly, the present invention relates to methods for processing audio signals.

2. Description of the Related Art

Existing matrixed surround decoders such as Dolby Prologic or DTS Neo:6 are designed to "upmix" 2-channel audio recordings for playback over multichannel loudspeaker systems. These decoders assume that sounds are directionally encoded in the 2-channel signal by panning laws that introduce inter-channel amplitude and phase differences specifying any desired position on a horizontal circle surrounding the listener's position. Known limitations of these decoders include (1) their inability to discriminate and accurately position concurrent sounds panned at different positions in space, (2) their inability to discriminate and accurately reproduce ambient or spatially diffuse sounds, (3) their limitation to 2-D horizontal spatialization, (4) their inherent restriction to conventional multichannel audio rendering techniques (pairwise amplitude panning) and standard multichannel loudspeaker layouts (5.1, 7.1). It is desired to overcome these limitations.

What is desired is an improved matrix decoder.

SUMMARY OF THE INVENTION

This invention uses frequency-domain analysis/synthesis techniques similar to those described in the U.S. patent application Ser. No. 11/750,300 entitled "Spatial Audio Coding Based on Universal Spatial Cues" (incorporated herein by reference) but extended to include (A) methods for analysis of phase-amplitude matrix-encoded 2-channel stereo mixes and spatial rendering using various headphone or loudspeaker-based spatial audio reproduction techniques; (B) methods for 3-D positional phase-amplitude matrixed surround decoding that are backwards compatible with prior-art 2-D phase-amplitude matrixed surround decoders; and (C) methods for matrix decoding 2-channel stereo mixes including primary-ambient decomposition and separate spatial reproduction of primary and ambient signal components.

In accordance with one embodiment, provided is a frequency domain method for phase-amplitude matrixed surround decoding of 2-channel stereo recordings and soundtracks, based on spatial analysis of 2-D or 3-D directional cues in the recording and re-synthesis of these cues for reproduction on any headphone or loudspeaker playback system.

These and other features and advantages of the present invention are described below with reference to the drawings.

DETAILED DESCRIPTION OF PREFERRED EMBODIMENTS

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

Matrix Encoding Equations

Figure 1:
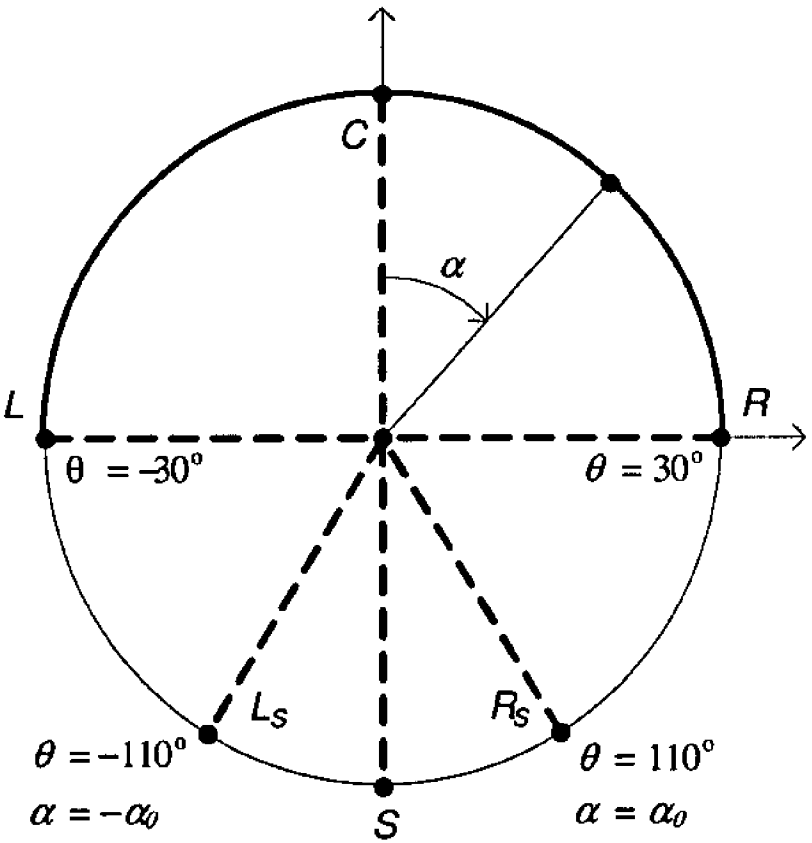
Fig. 1 (prior art)
FIG. 1 is a diagram illustrating matrix encoding on a notional encoding circle in the horizontal plane, as described in the prior art. The values of the amplitude panning angle $\alpha$ and of the physical localization angle $\theta$ are indicated for standard loudspeaker locations in the horizontal plane.

Considering a set of M monophonic source signals $\{S_m[t]\}$, we denote the general expression of the two-channel matrix-encoded stereo signal $\{L_T(t), R_T(t)\}$ as follows:

$$L_T(t)=\Sigma_m \rho_{Lm} S_m(t)$$

$$R_T(t)=\Sigma_m \rho_{Rm} S_m(t) \quad (1)$$

where $\rho_{Lm}$ and $\rho_{Rm}$ denote the left and right "panning" coefficients, respectively, for each source. Real-valued energy-preserving amplitude panning coefficients can be expressed, without loss of generality, by $$\rho_{Lm}(\alpha)=\cos(\alpha_m/2+\pi/4)$$

$$\rho_{Rm}(\alpha)=\sin(\alpha_m/2+\pi/4) \quad (2)$$

where $\alpha$ can be interpreted as a panning angle on the encoding circle as shown in FIG. 1. The points labeled L, C, R, $R_S$, S, and $L_S$ in FIG. 1 respectively denote the notional positions of the left, center, right, right surround, (center) surround and left surround loudspeakers on the encoding circle. As illustrated in FIG. 1, the corresponding physical loudspeaker positions are respectively at azimuth angles −30, 0, 30, 110, 180 and −110 degrees in the horizontal plane. For a spanning the interval $[-\pi, \pi]$ radians, all positions on the encoding circle of are uniquely encoded by Eq. (2), with panning coefficients of opposite polarity for positions in the rear half-circle (L-S-R).

The encoding equations (1, 2) can be used to mix a two-channel surround recording comprising multiple sound sources located at any position on a horizontal circle surrounding the listener, by defining a mapping of the due azimuth angle $\theta$ to the panning angle $\alpha$ (as illustrated in FIG. 1).

In recording practice, however, it is more common to produce a discrete multichannel recording prior to matrix encoding into two channels. The matrix encoding of any multichannel surround recording can be generally defined by considering each channel as one of the sources $S_m$ in the encoding equations (1, 2), with provision for applying an optional arbitrary phase shift in some of the source channels.

For instance, the standard 4-channel matrix encoding equations for the left (L), right (R), center (C) and surround (S) channels take the form $$L_T=L+1/\sqrt{2}C+0.7jS$$

$$R_T=R+1/\sqrt{2}C-0.7jS \quad (3)$$

where the surround channel S is assigned the panning angle $\alpha=\pi$, and j denotes an idealized 90-degree phase shift applied to the signal S, which has the effect of distributing the phase difference equally between the left and right channels.

For a standard 5-channel format consisting of the left (L), right (R), center (C), left surround ($L_S$), and right surround ($R_S$) channels, a set of matrix encoding equations used in the prior art is:

$$L_T=L+1/\sqrt{2}C+j(k_1L_S+k_2R_S)$$

$$R_T=R+1/\sqrt{2}C-j(k_1R_S+k_2L_S) \quad (4)$$

where the surround encoding phase differences are directly incorporated into the equation and the surround encoding coefficients $k_1$ and $k_2$ are $$k_1(\alpha_0)=|\cos(\alpha_0/2+\pi/4)|$$

$$k_2(\alpha_0)=|\sin(\alpha_0/2+\pi/4)| \quad (5)$$

with a surround encoding angle $\alpha_0$ chosen within $[\pi/2, \pi]$.

The matrix encoding scheme described above can be generalized to include arbitrary inter-channel phase differences according to $$\rho_L(\alpha,\beta)=\cos(\alpha/2+\pi/4)e^{j\beta/2}$$

$$\rho_R(\alpha,\beta)=\sin(\alpha/2+\pi/4)e^{-j\beta/2} \quad (6)$$

Figure 2:
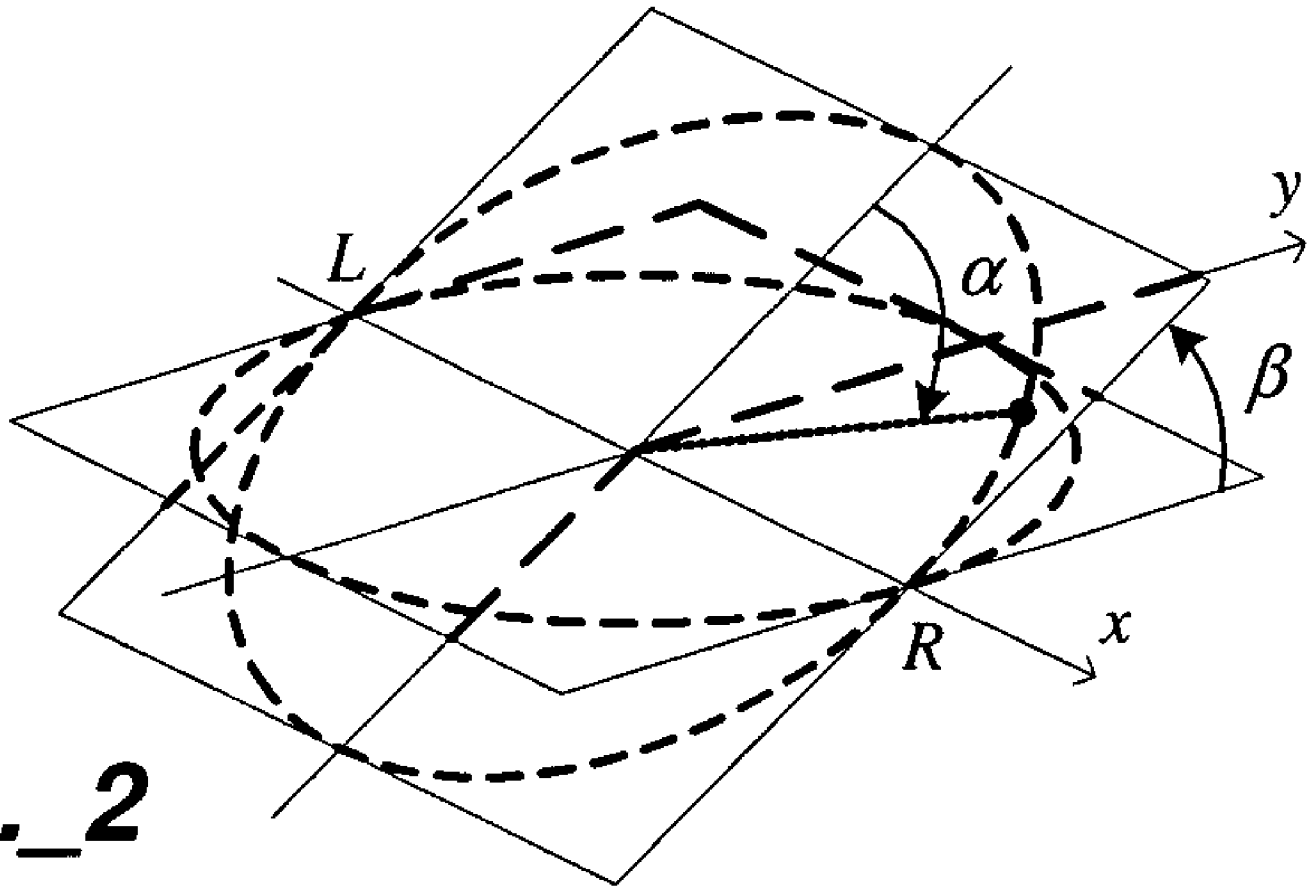
Fig. 2 (prior art)
FIG. 2 is a diagram illustrating phase-amplitude matrix encoding on a notional encoding sphere known as the "Scheiber sphere," as described in the prior art, represented by the amplitude panning angle $\alpha$ and the inter-channel phase-difference angle $\beta$.

In a graphical representation, as shown in FIG. 2, the inter-channel phase difference angle $\beta$ can be interpreted as a rotation around the left-right axis of the plane in which the amplitude panning angle $\alpha$ is measured. If $\alpha$ spans $[-\pi/2, \pi/2]$ and $\beta$ spans $[-\pi, \pi]$, the angle coordinates $(\alpha, \beta)$ uniquely map any inter-channel phase and/or amplitude difference to a position on a notional sphere known in the prior art as the "Scheiber sphere". In particular, $\beta=0$ describes the frontal arc (L-C-R) and $\beta=\pi$ describes the rear arc (L-S-R) of the encoding circle. By convention, positive values of $\beta$ may be taken to correspond to the upper hemisphere and negative values of $\beta$ to the lower hemisphere.

Prior-Art Passive Matrixed Surround Decoders

Figure 3:
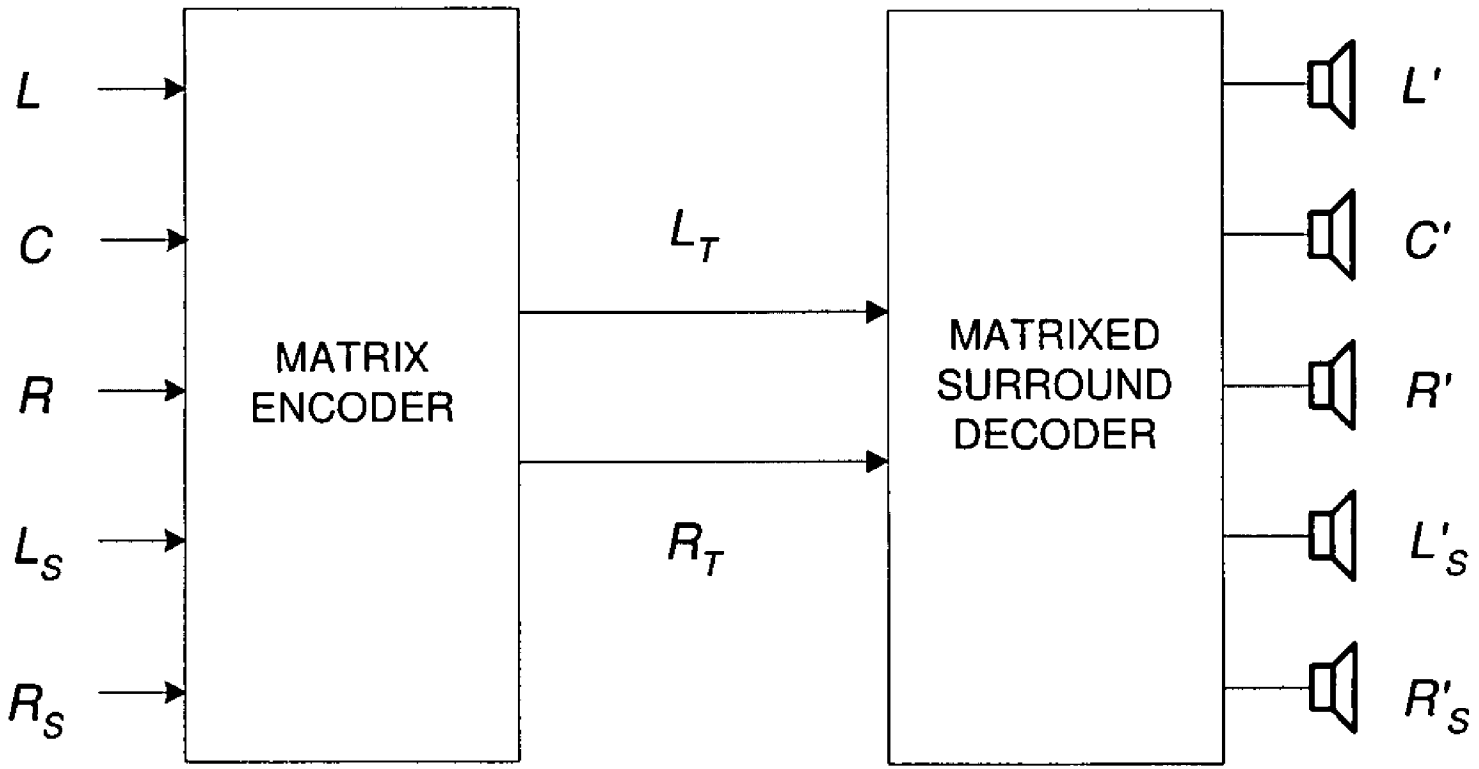
FIG. 3 is a diagram illustrating a 5-2-5 matrix encoding/decoding scheme where a 5-channel recording feeds a multichannel matrix encoder to produce a 2-channel matrix-encoded signal and the matrix-encoded signal then feeds a matrix decoder to produce 5 output signals for reproduction over loudspeakers.

FIG. 3 depicts a 5-2-5 matrix encoding/decoding scheme where a 5-channel recording feeds a multichannel matrix encoder to produce the matrix-encoded 2-channel signal $\{L_T(t), R_T(t)\}$, and the matrix-encoded signal then feeds a matrixed surround decoder to produce 5 loudspeaker output channel signals for reproduction. In general, the purpose of such a matrix encoding/decoding scheme is to reproduce a listening experience that closely approaches that of listening to the original N-channel signal over loudspeaker located at the same N positions around a listener.

Given a pair of matrix-encoded signals $\{L_T(t), R_T(t)\}$, passive decoding is a straightforward method of forming a set of N output channels $\{Y_n(t)\}$ for reproduction with N loudspeakers. According to a prior-art passive decoding method, each output channel signal is formed as a linear combination of the encoded signals according to $$Y_n(t)=\rho^*_{Ln}(\alpha_n,\beta_n)L_T(t)+\rho^*_{Rn}(\alpha_n,\beta_n)R_T(t) \quad (7)$$

where * denotes complex conjugation, and the values of the decoding coefficients $\rho_{Ln}(\alpha_n, \beta_n)$ and $\rho_{Rn}(\alpha_n, \beta_n)$ for a loudspeaker with a notional position $(\alpha_n, \beta_n)$ on the encoding circle or sphere are the same as the values of the encoding coefficients for a source at the corresponding position, as given by Eq. (2). By substituting Eqs. (1, 2) into Eq. (7), it can be shown that a passive matrix encoding/decoding scheme perfectly transmits each input channel $S(\alpha, \beta)$ to an output channel $Y(\alpha, \beta)$ at the same location on the Scheiber sphere (or on the encoding circle). However, each output channel also receives a contribution from other input channels, whose amplitude depends on the distance of the input and output channels on the Scheiber sphere. Specifically, for real encoding and decoding coefficients ($\beta=0$), $$Y_n=\Sigma_m S_m \cos[(\alpha_n-\alpha_m)/2] \quad (8)$$

This shows, as is well known in the prior art, that the performance of the N-2-N encoding/decoding scheme in terms of source separation is perfect for channels that are diametrically opposite on the Scheiber sphere or on the encoding circle, but generally poor otherwise. For instance, with a passive matrix decoding scheme, source separation is never better than 3 dB for channels located in the same quarter of the encoding circle. The consequence of this poor source separation performance is that the subjective localization of sounds in reproduction of the output signals over loudspeakers is much less sharp and defined that in the original multichannel recording.

Prior-Art Active Matrixed Surround Decoders

By varying the decoding coefficients $\rho_{Ln}$ and $\rho_{Rn}$ in Eq. (7), an active matrixed surround decoder can improve the source separation performance compared to that of a passive matrix decoder in conditions where the matrix-encoded signal presents a strong directional dominance. Existing active matrixed surround decoders assume that the matrix-encoded signal $\{L_T, R_T\}$ was generated by matrix encoding of an original multichannel recording intended for reproduction in a horizontal-only multichannel surround loudspeaker layout such as the standard 4-channel and 5-channel formats. They also inherently assume that the multichannel output of the matrix decoder is produced for the same multichannel horizontal-only playback format or a close variant of it.

In such active decoders, an improvement in perceived source separation is achieved by use of a "steering" algorithm which continuously adapts the decoding coefficients according to a measured "dominance vector." This dominance vector, denoted hereafter $\delta=\{\delta_x, \delta_y\}$, is computed from the encoded signals as $$\delta_x=(\|R_T\|^2-\|L_T\|^2)/(\|R_T\|^2+\|L_T\|^2)$$

$$\delta_y=(\|L_T\|^2+\|R_T\|^2)-(\|L_T-R_T\|^2)/(\|L_T+R_T\|^2)+(\|L_T-R_T\|^2) \quad (9)$$

where the squared norm $\|.\|^2$ denotes signal power.

The magnitude of the dominance vector $|\delta|$ measures the degree of directional dominance in the two-channel matrix-encoded signal $\{L_T, R_T\}$ and is never more than 1; therefore the dominance vector $\delta$ always falls on or within the encoding circle.

When the matrix encoded signal $\{L_T, R_T\}$ represents a single sound source encoded at notional position $\{\alpha, \beta\}$ on the Scheiber sphere, the dominance vector can be shown to coincide with the projection of the position $\{\alpha, \beta\}$ onto the horizontal plane $$\delta'_x=\sin\alpha$$

$$\delta'_y=\cos\alpha\cos\beta \quad (10)$$

Figure 4:
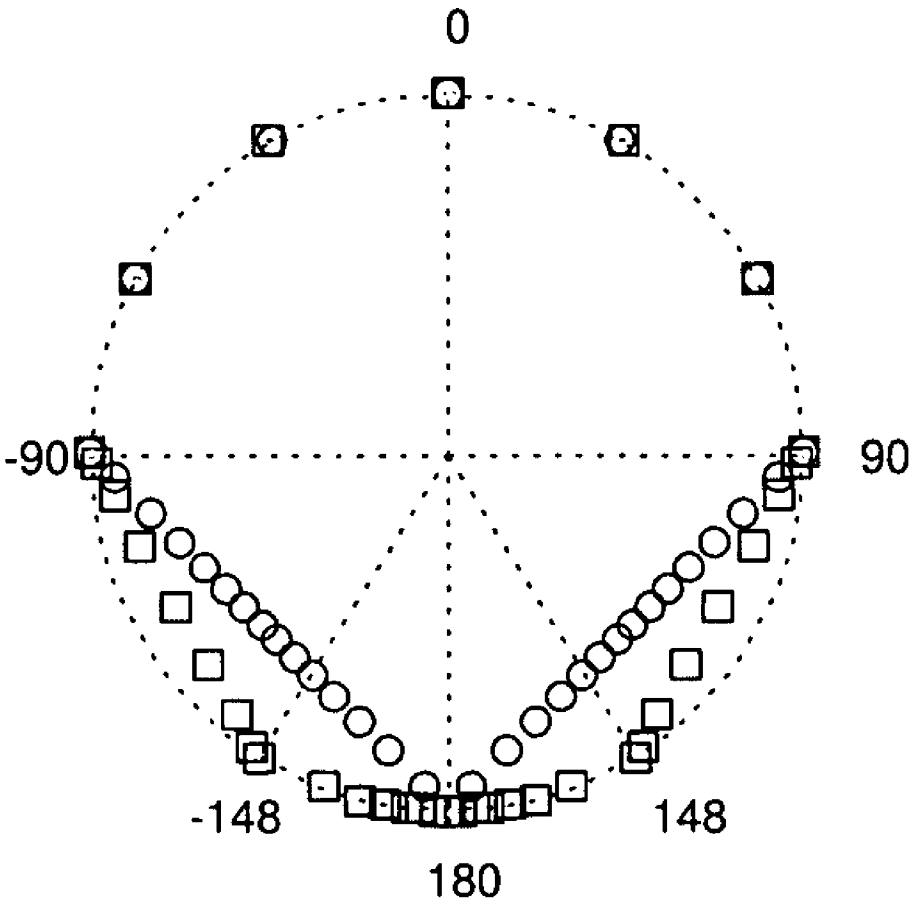
Fig. 4 (prior art)
FIG. 4 is a diagram illustrating the encoding locus obtained by matrix encoding applied to a 4-channel recording or to a 5-channel recording.

When a single sound source is pairwise panned between two adjacent channels in the original multichannel recording, the magnitude of the dominance vector $|\delta|$ is maximum and the dominance vector points towards the due position of the sound source. The resulting encoding locus is illustrated in FIG. 4, where the dominance vector is plotted for a pairwise panned sound source in 10-degree azimuth increments. In FIG. 4, circle symbols (○) represent the dominance vector positions obtained when the original recording is in the standard 4-channel format (L, C, R, S), matrix-encoded according to Eq. (3). Square symbols (□) represent the dominance vector positions obtained when the original recording is in the standard 5-channel format (L, C, R, Ls, Rs), matrix-encoded according to Eq. (4) and the surround encoding angle $\alpha_0$ defined in Eq. (5) is 148 degrees.

By dynamically tracking directional dominance, prior-art active time-domain matrixed surround decoders are, in theory, able to correctly reproduce a single discrete sound source pairwise panned to any position around the listener over a horizontal multichannel surround loudspeaker reproduction system. This involves dynamically adjusting the decoding coefficients to mute the decoder output channels that are not directly adjacent to the estimated sound position indicated by the dominance vector.

When the signals $L_T$ and $R_T$ are uncorrelated or weakly correlated (i.e. representing exclusively ambience or reverberation), the dominance vector defined by Eq. (9) tends towards zero and prior-art active decoders revert to passive decoding behavior as described previously. This also occurs in the presence of a plurality of concurrent sources evenly distributed around the encoding circle.

Therefore, in addition to being limited to specific horizontal loudspeaker reproduction formats, existing 5-2-5 or N-2-N matrix encoding/decoding systems based on time-domain passive or active matrixed surround decoders inevitably exhibit poor source separation in the presence of multiple concurrent sound sources and, conversely, poor preservation of the diffuse spatial distribution of ambient sound components in the presence of a dominant directional source.

Improved Phase-Amplitude Matrixed Surround Decoder

In accordance with one embodiment of the invention, provided is a frequency domain method for phase-amplitude matrixed surround decoding of 2-channel stereo signals such as music recordings and movie or video game soundtracks, based on spatial analysis of 2-D or 3-D directional cues in the input signal and re-synthesis of these cues for reproduction on any headphone or loudspeaker playback system. As will be apparent in the following description, this invention enables the decoding of 3-D localization cues from two-channel audio recordings while preserving backward compatibility with prior-art two-channel horizontal-only phase-amplitude matrixed surround formats such as described previously.

The present invention uses a time/frequency analysis and synthesis framework to significantly improve the source separation performance of the matrixed surround decoder. The fundamental advantage of performing the analysis as a function of both time and frequency is that it significantly reduces the likelihood of concurrence or overlap of multiple sources in the signal representation, and thereby improves source separation. If the frequency resolution of the analysis is comparable to that of the human auditory system, the possible effects of any source overlap in the frequency-domain representation may be perceptually masked during reproduction of the decoder's output signal over headphones or loudspeakers.

Figure 5:
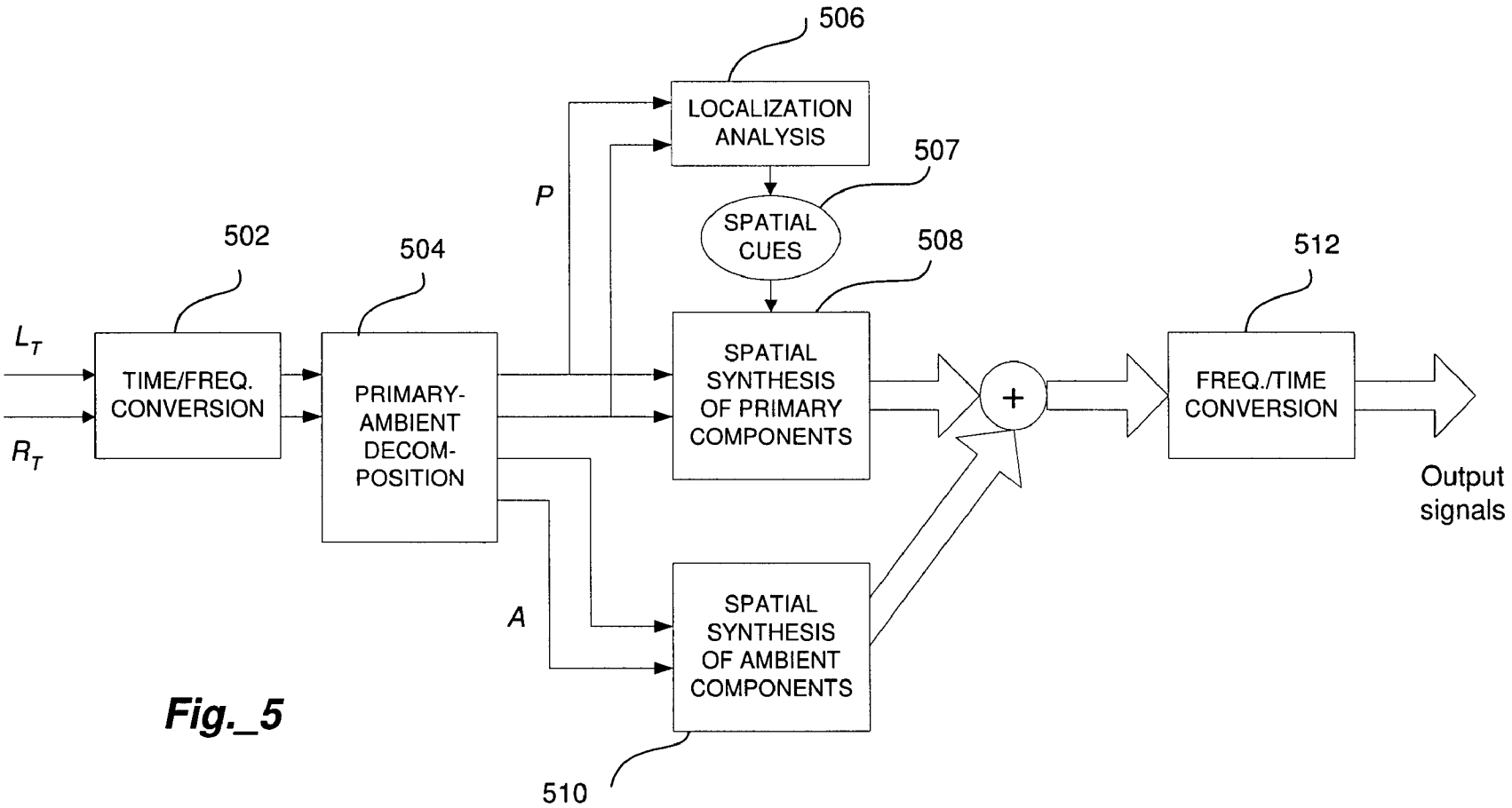
FIG. 5 is a signal flow diagram illustrating an improved phase-amplitude matrixed surround decoder in accordance with one embodiment of the present invention.

FIG. 5 is a signal flow diagram illustrating a phase-amplitude matrixed surround decoder in accordance with one embodiment of the present invention. Initially, a time/frequency conversion takes place in block 502 according to any conventional method known to those of skill in the relevant arts, including but not limited to the use of a short term Fourier transform (STFT).

Next, in block 504, a primary-ambient decomposition occurs. This decomposition is advantageous because primary signal components (typically direct-path sounds) and ambient components (such as reverberation or applause) generally require different spatial synthesis strategies. The primary-ambient decomposition separates the two-channel input signal $S=\{L_T, R_T\}$ into a primary signal $P=\{P_L, P_R\}$ whose channels are mutually correlated and an ambient signal $A=\{A_L, A_R\}$ whose channels are mutually uncorrelated or weekly correlated, such that a combination of signals P and A reconstructs an approximation of signal S and the contribution of ambient components in signal S are significantly reduced in the primary signal P. Frequency-domain methods for primary-ambient decomposition are described in the prior art, for instance by Merimaa et al. in "Correlation-Based Ambience Extraction from Stereo Recordings", presented at the 123rd Convention of the Audio Engineering Society (October 2007).

The primary signal $P=\{P_L, P_R\}$ is then subjected to a localization analysis in block 506. For each time and frequency, the spatial analysis derives a spatial localization vector representative of a physical position relative to the listener's head. This localization vector may be three-dimensional or two-dimensional, depending of the desired mode of reproduction of the decoder's output signal. In the three-dimensional case, the localization vector represents a position on a listening sphere centered on the listener's head, characterized by an azimuth angle $\theta$ and an elevation angle $\phi$. In the two-dimensional case, the localization vector may be taken to represent a position on or within a circle centered on the listener's head in the horizontal plane, characterized by an azimuth angle $\theta$ and a radius r. This two-dimensional representation enables, for instance, the parametrization of fly-by and fly-through sound trajectories in a horizontal multichannel playback system.

In the localization analysis block 506, the spatial localization vector is derived, for each time and frequency, from the inter-channel amplitude and phase differences present in the signal P. These inter-channel differences can be uniquely represented by a notional position $\{\alpha, \beta\}$ on the Scheiber sphere as illustrated in FIG. 2, according to Eq. (6), where $\alpha$ denotes the panning angle and $\beta$ denotes the inter-channel phase difference. According to Eqs. (2) or (6), the panning angle $\alpha$ is related to the inter-channel level difference $$m=\|P_L\|/\|P_R\| \text{ by}$$

$$\alpha=2\tan^{-1}(1/m)-\pi/2 \tag{11}$$

According to one embodiment on the invention, the operation of the localization analysis block 506 consists of computing the inter-channel amplitude and phase differences, followed by mapping from the notional position $\{\alpha,\beta\}$ on the Scheiber sphere to the direction $\{\theta, \phi\}$ in the three-dimensional physical space or to the position $\{\theta, r\}$ in the two-dimensional physical space. In general, this mapping may be defined in an arbitrary manner and may even depend on frequency.

According to another embodiment of the invention, the primary signal P is modeled as a mixture of elementary monophonic source signals $S_m$ according to the matrix encoding equations (1, 2) or (1, 6), where the notional encoding position $\{\alpha_m, \beta_m\}$ of each source is defined by a known bijective mapping from a two-dimensional or three-dimensional localization in a physical or virtual spatial sound scene. Such an mixture may be realized, for instance, by an audio mixing workstation or by an interactive audio rendering system such as found in video game consoles. In such applications, it is advantageous to implement the localization analysis block 506 such that the derived localization vector is obtained by inversion of the mapping realized by the matrix encoding equations, so that playback of the decoder's output signal reproduces the original spatial sound scene.

In another embodiment of the present invention, the localization analysis 506 is performed, at each time and frequency, by computing the dominance vector according to Eq. (9) and applying a mapping from the dominance vector position in the encoding circle to a physical position $\{\theta, r\}$ in the horizontal listening circle, as illustrated in FIG. 1. Alternatively, the dominance vector position may then be mapped to a three-dimensional localization $\{\theta, \phi\}$ by vertical projection from the listening circle to the listening sphere as follows:

$$\phi=\cos^{-1}(r)\text{sign}(\beta) \tag{12}$$

where the sign of the inter-channel difference $\beta$ is used to differentiate the upper hemisphere from the lower hemisphere.

Block 508 realizes, in the frequency domain, the spatial synthesis of the primary components in the decoder output signal by applying to the primary signal P the spatial cues 507 derived by the localization analysis 506. A variety of approaches may be used for the spatial synthesis (or "spatialization") of the primary components from a monophonic signal, including ambisonic or binaural techniques as well as conventional amplitude panning methods. In one embodiment of the present invention, a mono signal P to be spatialized is derived, at each time and frequency, by a conventional mono downmix where $P=0.7\ (P_L+P_R)$. In another embodiment, the computation of the mono signal P uses downmix coefficients that depend on time and frequency by application of the passive upmix equation (7) at the position $\{\alpha, \beta\}$ derived from the inter-channel amplitude and phase differences computed in the localization analysis block 506:

$$P=\rho_L^*(\alpha,\beta)P_L+\rho_R^*(\alpha,\beta)P_R \tag{13}$$

In general, the spatialization method used in the primary component synthesis block 508 should seek to maximize the discreteness of the perceived localization of spatialized sound sources. For ambient components, on the other hand, the spatial synthesis method, implemented in block 510, should seek to reproduce (or even enhance) the spatial spread or diffuseness of sound components. As illustrated in FIG. 5, the ambient output signals generated in block 510 are added to the primary output signals generated in block 508. Finally, a frequency/time conversion takes place in block 512, such as through the use of an inverse STFT, in order to produce the decoder's output signal.

In an alternative embodiment of the present invention, the primary-ambient decomposition 504 and the spatial synthesis of ambient components 510 are omitted. In this case, the localization analysis 506 is applied directly to the input signal $\{L_T, R_T\}$.

In yet another embodiment of the present invention, the time-frequency conversions blocks 502 and 512 and the ambient processing blocks 504 and 510 are omitted. Despite these simplifications, a matrixed surround decoder according to the present invention can offer significant improvements over prior art matrixed surround decoders, notably by enabling arbitrary 2-D or 3-D spatial mapping between the matrix-encoded signal representation and the reproduced sound scene.

Localization Analysis of Matrixed Multichannel Recordings

As explained earlier, legacy matrix-encoded content has been commonly produced by first creating a discrete multichannel recording. This multichannel recording represents what is denoted as multichannel spatial cues. These multichannel spatial cues are transformed into amplitude and phase differences when the multichannel signals are encoded. The task of the localization analysis, as applied to matrixed multichannel recordings in one embodiment of the present invention, is then to derive such set of spatial cues from the encoded signals that substantially matches the multichannel spatial cues.

In one embodiment, the desired multichannel spatial cues correspond to a format-independent localization vector representative of a direction relative to the listener's head, as defined in the U.S. patent application Ser. No. 11/750,300 entitled Spatial Audio Coding Based on Universal Spatial Cues, incorporated herein for all purposes. Furthermore, the magnitude of this vector describes the radial position relative to the center of a listening circle—so as to enable parametrization of fly-by and fly-through sound events. The localization vector is obtained by applying a magnitude correction to the Gerzon vector, which is computed from the multichannel signal.

The Gerzon vector g is defined as follows:

$$g=\Sigma_m s_m e_m \tag{14}$$

where $e_m$ is a unit vector in the direction of the m-th input channel, denoted hereafter as a format vector, and the weights $s_m$ are given by $$s_m=\|S_m\|/\Sigma_m\|S_m\| \text{ for the "Gerzon velocity vector"} \tag{15}$$

$$s_m=\|S_m\|^2/\Sigma_m\|S_m\|^2 \text{ for the "Gerzon intensity vector"} \tag{16}$$

where $S_m$ is the signal of the m-th input channel. While the direction of the Gerzon vector can take on any value, its radius is limited such that it always lies within (or on) the inscribed polygon whose vertices are at the format vector endpoints on the unit circle. Positions on the polygon are attained only for pairwise-panned sources.

In order to enable accurate and format-independent spatial analysis and representation of arbitrary sound locations in the listening circle, an enhanced localization vector d is computed in the analysis of the multichannel localization cues as follows:

1. Find the adjacent format vectors on either side of the Gerzon vector g; these are denoted hereafter by $e_i$ and $e_j$.

2. Using the matrix $E_{ij}=[e_i e_j]$, scale the magnitude of the Gerzon vector to obtain the localization vector d:

$$r=\|(E_{ij})^{-1}g\|_1$$

$$d=rg/\|g\| \tag{17}$$

where the radius r of the localization vector d is expressed as the sum of the two weights that would be needed for a linear combination of $e_i$ and $e_j$ to match the Gerzon vector g. The vector magnitude correction by equation (17) has the effect of expanding the localization encoding locus to the entire unit circle (or sphere), so that pairwise panned sounds are encoded on its boundary. The localization vector d has the same direction as the Gerzon vector g.

In one embodiment of block 506, the direction and magnitude of the dominance vector are mapped to the direction and magnitude of the localization vector, respectively. The directional mapping is implemented such that, for an encoding of a pairwise-panned source, the direction of the derived localization vector corresponds to the direction that would be obtained by computing the localization vector from the original multichannel recording. The magnitude of the dominance vector is directly converted to the magnitude of the localization vector for signals in the frontal sector ($\delta_y \geqq 0$) of the encoding circle where pairwise amplitude panning yields a full dominance. For $\delta_y<0$, a magnitude correction is devised such that the magnitude of the localization vector is always extended to 1 when the encoded input signals represent pairwise amplitude panning of a single sound source.

Figure 6A:
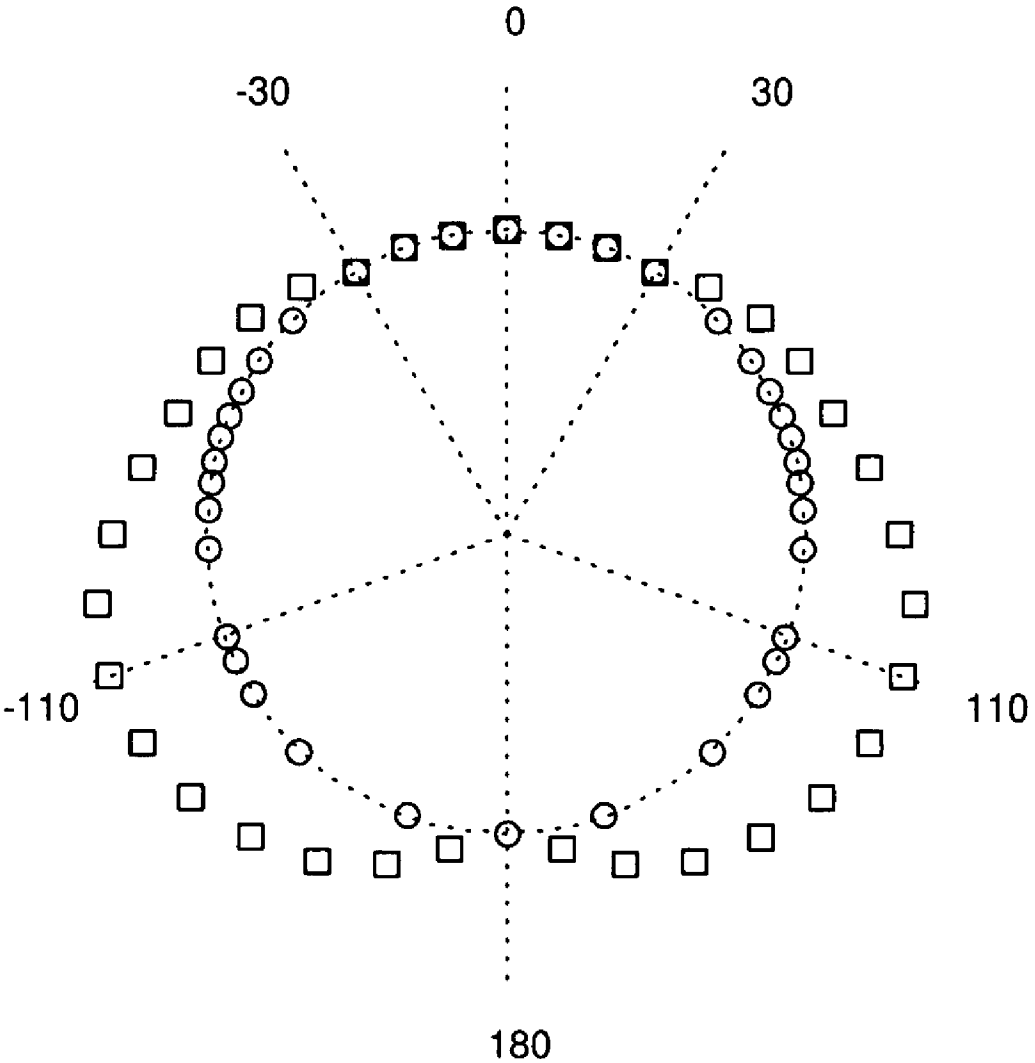
FIG. 6A is a diagram illustrating the localization vectors derived from the dominance vector in a matrixed surround decoder optimized for accurate angular reproduction of 5-channel encoded material and enhancement of surround panning effects in 4-channel encoded material.

Based on FIG. 4, it is obvious that, apart from the frontal sector and the rear center position, an ideal mapping from the dominance vector 6 to the localization vector d, as outlined above, requires knowledge of the encoding format and equations. In general, this information is not available to the matrix decoder, and must be assumed a priori in its design. As a practical compromise, the preferred embodiment opts for an angular mapping that ensures consistent reproduction of pairwise panned sources for 5-channel recordings encoded according to Eq. (4), since accurate angular reproduction on the sides is typically not expected for encoded material derived from a 4-channel (L, C, R, S) recording (Eq. 3). The magnitude correction, however, is implemented such that the 4-channel pan loci shown in FIG. 4 map to the circle, and by limiting r to one. This solution ensures consistent decoding of pairwise-panned material encoded from 5-channel sources while maximizing the discreteness of panned surround effects when decoding material encoded from 4 channels. The resulting mapping is illustrated in FIG. 6A, where the localization vector derived from the encoded signals is presented for a pairwise panned source in 10-degree azimuth increments in the original format with encoding performed according to Eq. (3) (circle symbols) and Eq. (4) (square symbols). For illustrative purposes, the localization vector is shown prior to limiting its magnitude and after the limiting, the squared symbols lie on the unit circle at 10-degree spacing, corresponding exactly to the encoded multichannel spatial cues.

In one embodiment using the Gerzon velocity vector as the means of deriving the multichannel spatial cues, the directional mapping from the dominance vector to the localization vector is derived as follows. For a pairwise-panned source between channels i and j, the Gerzon velocity vector as defined in Eq. (14) can be expressed as $$g=(m_{ij}e_i+e_j)/(m_{ij}+1) \tag{18}$$

where $m_{ij}=\|S_i\|/\|S_j\|$ and $S_i$ and $S_j$ are the signals of the corresponding channels. Thus it is sufficient to recover the level difference of the two channels in order to obtain the Gerzon vector. Consider a signal originally panned between the left and center channels and let C=X and $L=m_{LC}$ X, where $m_{LC}=\|L\|/\|C\|$, X is and arbitrary signal and all other original channels are zero. Furthermore, let $$m_\delta=\delta_y/\delta_y=\tan\alpha' \tag{19}$$

where α' is the angle of the dominance vector within the encoding plane and $\delta_y \neq 0$. Now, based on Eqs. (4), (9), and (14)

$$m_\delta=-\frac{m_{LC}^2+\sqrt{2}\,m_{LC}}{1+\sqrt{2}\,m_{LC}} \tag{20}$$

Solving for $m_{LC}$ under the constraint that $m_{LC} \geqq 0$ we have $$m_{LC}=-\frac{m_\delta+1-\sqrt{m_\delta^2+1}}{\sqrt{2}} \tag{21}$$

By applying a similar procedure to a discrete source amplitude-panned between each pair of adjacent loudspeakers in a standard 5-channel configuration, and by noting that the loudspeaker pair between which the amplitude panning was performed can be identified based on the dominance vector, the active channels and their level difference corresponding to any δ where $\delta_y \neq 0$ can be determined. The results are listed in Table 1. Furthermore, $\delta_y=0$ occurs when (a) only L or R is active and the active channel can be identified based on the sign of $\delta_x$ or (b) by definition when all encoded channels are zero and the results are arbitrarily chosen to indicate activity in channel R.

Figure 6B:
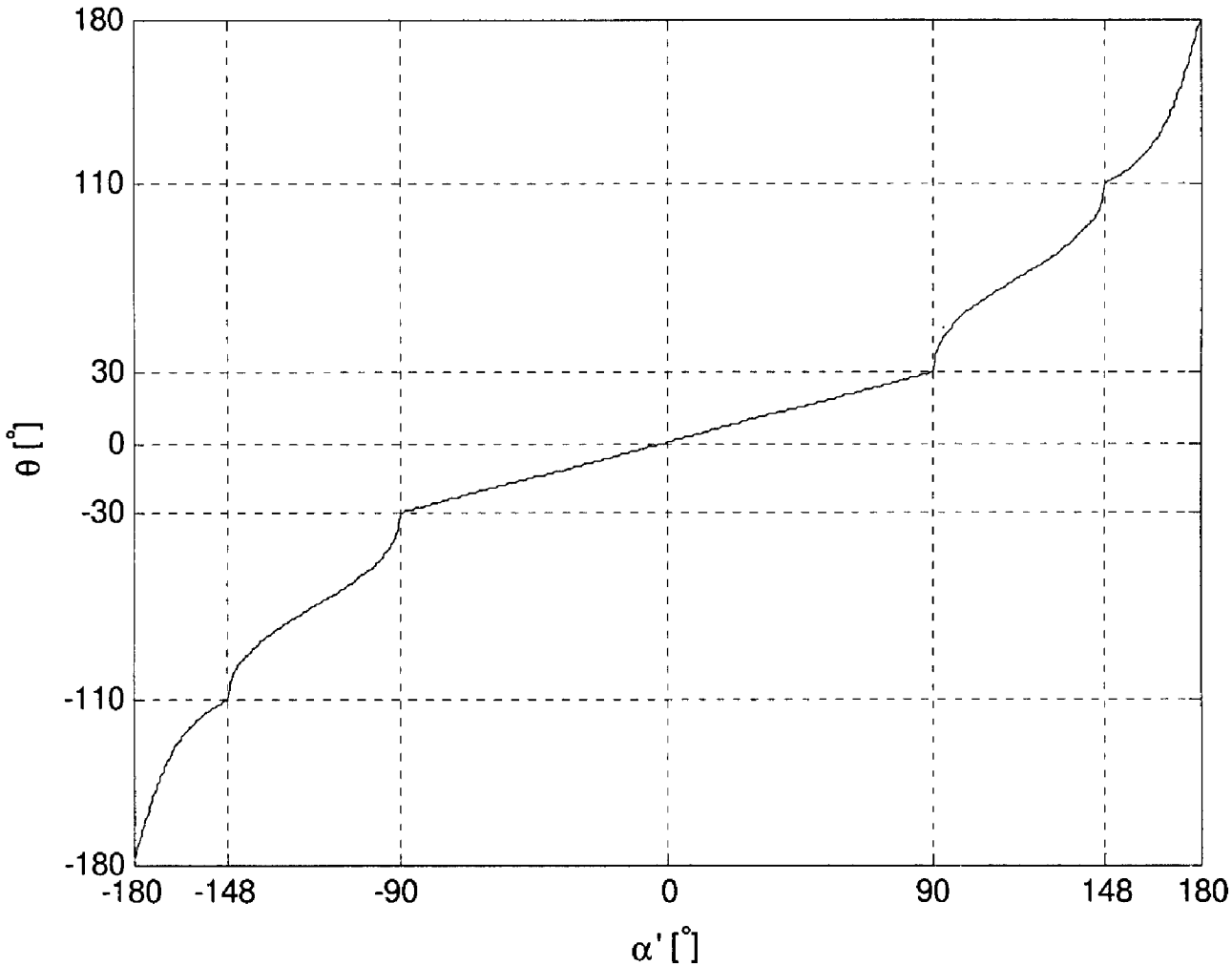
FIG. 6B is a plot illustrating the mapping from the dominance direction angle $\alpha'$ to the localization vector azimuth angle $\theta$ for a matrix encoded signal originally derived from a 5-channel recording, in accordance with one embodiment of the present invention.

Based on Table 1, the Gerzon vector corresponding to the identified channels i,j, and level difference $m_{ij}$ is computed according to Eq. (18). The direction of the resulting Gerzon vector is illustrated in FIG. 6B as a function of α'. Corresponding mappings can be derived with the same procedure for any encoding equations, including but not limited to the 4-channel equations in Eq. (3).

TABLE 1

| $\delta_y$ | $m_\delta$ | i, j | $m_{ij}$ |
|---|---|---|---|
| >0 | <0 | L, C | $-\frac{m_\delta + 1 - \sqrt{m_\delta^2 + 1}}{\sqrt{2}}$ |
| >0 | ≧0 | R, C | $\frac{m_\delta - 1 + \sqrt{m_\delta^2 + 1}}{\sqrt{2}}$ |
| <0 | $\leq -\frac{k_1^2 - k_2^2}{2k_1k_2}$ | R, $R_S$ | $\sqrt{-2k_1k_2m_\delta - k_1^2 + k_2^2}$ |
| <0 | $\left(-\frac{k_1^2 - k_2^2}{2k_1k_2}, \frac{k_1^2 - k_2^2}{2k_1k_2}\right)$ | $L_S$, $R_S$ | $\frac{m_\delta + \sqrt{(1 - 4k_1^2k_2^2)m_\delta + (k_1^2 - k_2^2)^2}}{k_1^2 - k_2^2 - 2k_1k_2m_\delta}$ |
| <0 | $\geq \frac{k_1^2 - k_2^2}{2k_1k_2}$ | L, $L_S$ | $\sqrt{-2k_1k_2m_\delta - k_1^2 + k_2^2}$ |
| 0 | Not defined | C, R if $\delta_x$ ≧ 0<br>C, L if $\delta_x$ < 0 | 0 |

The magnitude correction for the dominance vector is derived as follows. Based on Eq. (10), $\delta_y = \delta_{ycorr} \cos \beta_S$, where $\delta_{ycorr}$ is a corrected value corresponding to full dominance and $\beta_S$ the phase difference due to the 90-degree phase shifts in the encoding. Based on Eq. (3), it can be shown that for pairwise panning between the left and the surround channel or the right and the surround channel, $$\cos \beta_S = \min\{\|L_T\|, \|R_T\|\} / \max\{\|L_T\|, \|R_T\|\} \tag{22}$$

Thus, the magnitude of the localization vector is calculated using a modified dominance vector $$r = \begin{cases} \|\delta\| & \text{if } \delta_y \geq 0 \\ \min\left\{\left\|\left[\delta_x, \frac{\max\{\|L_T\|, \|R_T\|\}}{\min\{\|L_T\|, \|R_T\|\}}\delta_y\right]\right\|, 1\right\} & \text{if } \delta_y < 0 \end{cases} \tag{23}$$

A corresponding correction can be defined for any encoding equations including arbitrary phase shifts. Note that when $\delta_y < 0$, $\min\{\|L_T\|, \|R_T\|\} > 0$ and r is thus always defined.

Finally, the localization vector is computed according to $$d = rg/\|g\| \tag{24}$$

where the Gerzon vector g is computed using Eq. (18) with i,j, and $m_{ij}$ as specified in Table 1.

The preferred embodiment for localization analysis of matrixed multichannel recordings is summarized in the following steps:

1. Compute the dominance vector δ according to Eq. (9).
2. Determine i,j, and $m_{ij}$ based on Table 1.
3. Compute the Gerzon vector g according to Eq. (18).
4. Compute the magnitude of the localization vector r according to Eq. (23).
5. Compute the localization vector d according to Eq. (24).

Spatial Synthesis for Multichannel Surround Reproduction

Figure 7:
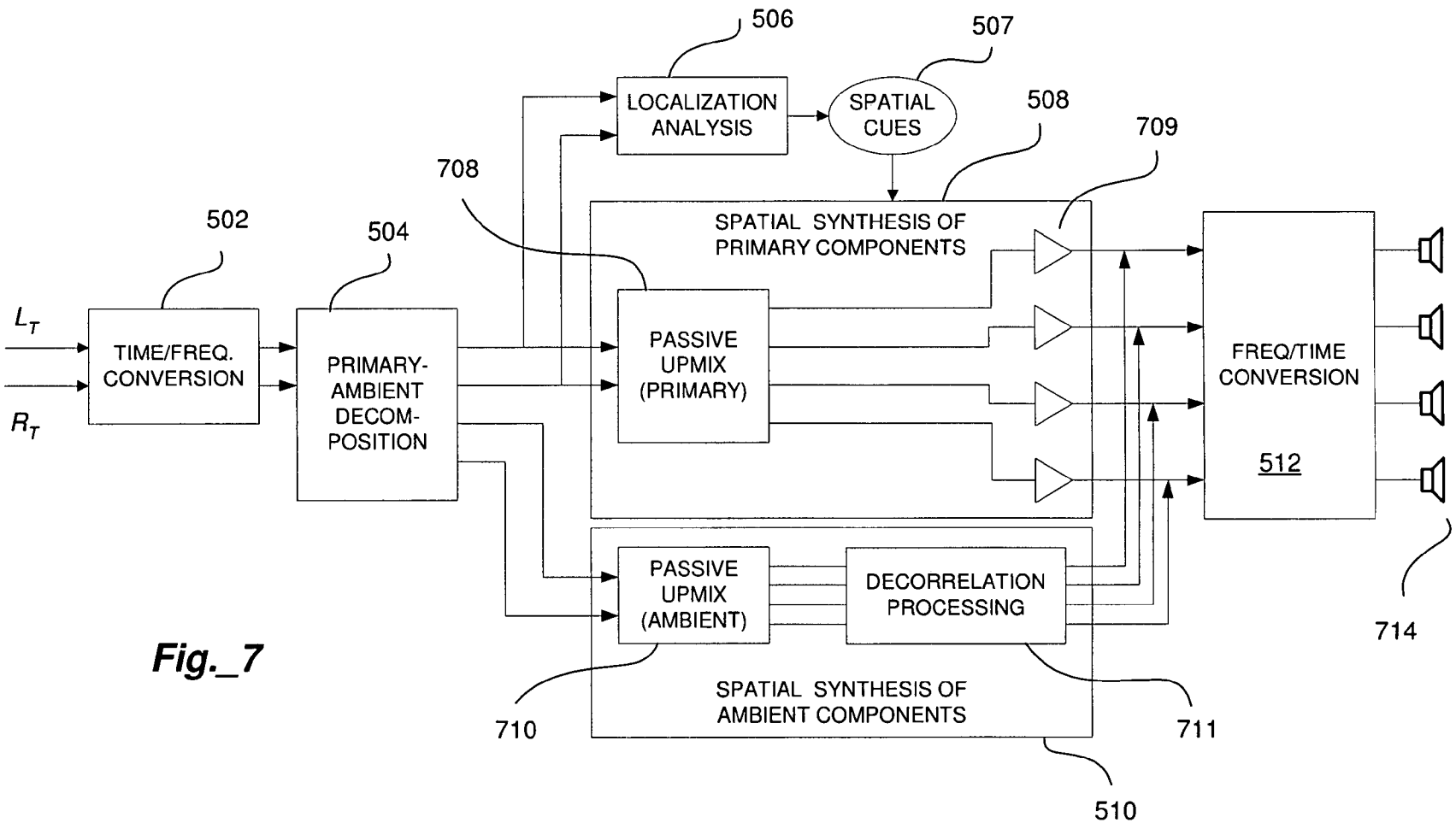
FIG. 7 is a signal flow diagram illustrating a phase-amplitude matrixed surround decoder for multichannel loudspeaker reproduction, in accordance with one embodiment of the present invention.

FIG. 7 is a signal flow diagram illustrating a phase-amplitude matrixed surround decoder for multichannel loudspeaker reproduction, in accordance with one embodiment of the present invention. The time/frequency conversion in block 502, primary-ambient decomposition in block 504 and localization analysis in block 506 are performed as described earlier. Given the time- and frequency-dependent spatial cues in block 507, the spatial synthesis of primary components in block 508 renders the primary signal $P = \{P_L, P_R\}$ to N output channels where N corresponds to the number of transducers in block 714. In the embodiment of FIG. 7, N=4, but the synthesis is applicable to any number of channels. Furthermore, the spatial synthesis of ambient components in block 510 renders the ambient signal $A = \{A_L, A_R\}$ to the same number of N output channels.

In one embodiment of block 708, the primary passive upmix forms a mono downmix of its input signal P and populates each of its output channels with this downmix. The mono primary downmix signal, denoted as $P_T$, may be derived by summing the channels $P_L$ and $P_R$ or by applying the passive decoding Eq. (7) for the time- and frequency-dependent target position {α, β} on the Scheiber sphere given by the dominance vector δ according to $$P_T = \rho^*_L(\alpha,\beta)P_L + \rho^*_R(\alpha,\beta)P_R \tag{25}$$

where $\rho_L(\alpha, \beta)$ and $\rho_R(\alpha, \beta)$ are given by Eq. (6) and the position {α, β} is related to the dominance vector 6 by Eq. (10). The spatial synthesis based on the mono downmix output channels of block 708 then consists of re-weighting the channels in block 709 with gain factors computed based on the spatial cues.

Using an intermediate mono downmix when upmixing a two-channel signal can lead to undesired spatial "leakage" or cross-talk: signal components presented exclusively in the left input channel may contribute to output channels on the right side as a result of spatial ambiguities due to frequency-domain overlap of concurrent sources. Although such overlap can be minimized by appropriate choice of the frequency-domain representation, it is preferable to minimize its potential impact on the reproduced scene by populating the output channels with a set of signals that preserves the spatial separation already provided in the decoder's input signal. In another embodiment of block 708, the primary passive upmix performs a passive matrix decoding into the N output signals according to Eq. (7) as $$P_{Tn}=\rho^{*}L(\alpha_n,\beta_n)P_L+\rho^{*}_R(\alpha_n,\beta_n)P_R \quad (26)$$

where $\{\alpha_n, \beta_n\}$ corresponds to the notional position of channel n on the Scheiber sphere. These signals are then re-weighted in block 709 with gain factors computed based on the spatial cues.

In one embodiment of block 709, the passively upmixed signals are weighted as defined in the U.S. patent application Ser. No. 11/750,300 entitled Spatial Audio Coding Based on Universal Spatial Cues. Applicants claim priority to said specification; further, said specification is incorporated herein by reference. The gain factors for each channel are determined by deriving multichannel panning coefficients based on the localization vector d and the output format which can be either given by user input or determined by automated estimation.

The derivation of the multichannel panning coefficients is driven by a consistency requirement: multichannel localization analysis of the reproduced audio scene should yield the same spatial cue information that was used to synthesize the scene. A set of panning coefficients satisfying this requirement for any localization d on or within the encoding circle or sphere is obtained by combining a set of pairwise panning coefficients $\lambda$ corresponding to the direction $\theta$ of the localization vector d and a set of non-directional panning weights according to $$\gamma=r\gamma+(1-r)\epsilon \quad (27)$$

where r is the magnitude of the localization vector d. The pairwise-panning coefficient vector $\lambda$ has one vector element for each output channel and contains non-zero coefficients only for the two output channels that bracket the direction $\theta$. Pairwise amplitude panning using the tangent law or the equivalent vector-base amplitude panning method yields a solution for $\lambda$ that is consistent with spatial cue analysis based on the Gerzon velocity vector. The non-directional panning coefficient vector $\epsilon$ is a set of panning weights for each output channel such that the set yields a Gerzon vector of zero magnitude. An optimization algorithm to find such weights for an arbitrary loudspeaker configuration is given in the U.S. patent application Ser. No. 11/750,300 entitled Spatial Audio Coding Based on Universal Spatial Cues, incorporated herein by reference.

Block 510 in FIG. 7 illustrates one embodiment of spatial synthesis of ambient components. In general, the spatial synthesis of ambience should seek to reproduce (or even enhance) the spatial spread or diffuseness of the corresponding sound components. In block 710, the ambient passive upmix first distributes the ambient signals $\{A_L, A_R\}$ to each output signal of the block based on the given output format. In one embodiment, the left-right separation is maintained for pairs of output channels that are symmetric in the left-right direction. That is, $A_L$ is distributed to the left and $A_R$ to the right channel of such a pair. For non-symmetric channel configurations, passive upmix coefficients for the signals $\{A_L, A_R\}$ may be obtained as for the passive primary upmix above. Each channel is then weighted such that the total energy of the output signals matches that of the input signals, and the reproduction gives a zero Gerzon vector. The weighting coefficients can be computed as specified in the U.S. patent application Ser. No. 11/750,300 entitled Spatial Audio Coding Based on Universal Spatial Cues, incorporated herein by reference.

In one embodiment of the spatial synthesis of ambient components in block 510 of FIG. 7, the passively upmixed ambient signals are decorrelated in block 711. In one embodiment of block 711, depending on the operation of the passive upmix block 710, allpass filters are applied to part of the ambient channels such that all output channels of block 711 are mutually uncorrelated, but any other decorrelation method known to those of skill in the relevant arts is similarly viable. The decorrelation processing may also include delay elements.

Finally, the primary and ambient signals corresponding to each output channel n are summed and converted to the time domain in block 512. The time-domain signals are then directed to the N transducers 714.

The methods described are expected to result in a significant improvement in the spatial quality of reproduction of 2-channel Dolby-Surround movie soundtracks over headphones or loudspeakers, because this invention enables a listening experience that is a close approximation of that provided with a discrete 5.1 multichannel recording or soundtrack in Dolby Digital or DTS format.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for deriving encoded spatial cues from an audio input signal having a first channel signal and a second channel signal comprising:

(a) converting the first and second channel signals to one of a frequency-domain or subband representation comprising a plurality of time-frequency tiles; and (b) deriving a direction for each time-frequency tile in the plurality by considering both the inter-channel amplitude difference and the inter-channel phase difference between the first channel signal and the second channel signal.

2. The method recited in claim 1 where deriving the direction for each time-frequency tile includes mapping the inter-channel differences to a position on a notional sphere or within a notional circle, such that the inter-channel phase difference maps to a position coordinate along a front-back axis.

3. The method recited in claim 1 where the input signal is obtained by phase-amplitude matrix encoding of a multichannel recording having multichannel spatial cues, and the derived encoded spatial cues substantially match the multichannel spatial cues of the multichannel recording.

4. The method recited in claim 1 further comprising separating ambient sound components from primary sound components in the audio input signal and deriving the direction for the primary sound components only.

5. A method for generating a decoded output signal, the method comprising:

(a) converting a first and second channel signal of an audio input signal to one of a frequency-domain or subband representation comprising a plurality of time-frequency tiles; and (b) deriving encoded spatial cues by at least deriving a direction for each time-frequency tile in the plurality by considering both the inter-channel amplitude difference and the inter-channel phase difference between the first channel signal and the second channel signal; and c) generating a decoded output signal for reproduction over headphones or loudspeakers having output spatial cues that are consistent with the derived encoded spatial cues.

6. The method as recited in claim 5 further comprising deriving an intermediate mono downmix signal from the audio input signal and wherein the decoded output signal is obtained by spatializing the intermediate mono downmix signal in accordance with the derived encoded spatial cues using a spatialization technique.

7. The method as recited in claim 5 wherein an intermediate multichannel signal is derived by passive upmix from the audio input signal and the decoded output signal is obtained by weighting individual channels of the intermediate multichannel signal in accordance with the derived encoded spatial cues.

8. A phase-amplitude matrixed surround decoder having a processing circuit configured to perform the method recited in claim 1 and further configured to generate a decoded output signal for reproduction over headphones or loudspeakers having output spatial cues that are consistent with the derived encoded spatial cues.

9. The phase-amplitude matrixed surround decoder as recited in claim 8 further configured to derive an intermediate mono downmix signal from the audio input signal and wherein the decoded output signal is obtained by spatializing the intermediate mono downmix signal in accordance with the derived encoded spatial cues using a spatialization technique.

10. The phase-amplitude matrixed surround decoder as recited in claim 8 where an intermediate multichannel signal is derived by passive upmix from the audio input signal and the decoded output signal is obtained by weighting individual channels of the intermediate multichannel signal in accordance with the derived encoded spatial cues.

* * * * *